US007275370B2

(12) United States Patent
Hesse et al.

(10) Patent No.: US 7,275,370 B2
(45) Date of Patent: Oct. 2, 2007

(54) CONTROL ARRANGEMENT AND METHOD FOR CONTROLLING AT LEAST TWO HYDRAULIC CONSUMERS

(75) Inventors: Horst Hesse, Stuttgart (DE); Gerhard F. J. Keuper, Leonberg (DE); Neinrich Loedige, Vaihingen (DE)

(73) Assignee: Bosch Rexroth AG, Stuttgart (DE)

( * ) Notice: Subject to any disclaimer, the term of this patent is extended or adjusted under 35 U.S.C. 154(b) by 0 days.

(21) Appl. No.: 10/562,114

(22) PCT Filed: Jul. 15, 2004

(86) PCT No.: PCT/DE2004/001536

§ 371 (c)(1),
(2), (4) Date: Dec. 23, 2005

(87) PCT Pub. No.: WO2005/008076

PCT Pub. Date: Jan. 27, 2005

(65) Prior Publication Data

US 2006/0230753 A1 Oct. 19, 2006

(30) Foreign Application Priority Data

Jul. 15, 2003 (DE) ..... 103 32 120

(51) Int. Cl.
*F15B 11/16* (2006.01)
*F15B 21/08* (2006.01)
*E02F 9/22* (2006.01)

(52) U.S. Cl. ..... 60/445; 60/484

(58) Field of Classification Search ..... 60/422, 60/445, 450, 452, 484
See application file for complete search history.

(56) References Cited

U.S. PATENT DOCUMENTS

| | | | | |
|---|---|---|---|---|
| 4,353,289 | A * | 10/1982 | Lonnemo | 91/420 |
| 4,884,402 | A * | 12/1989 | Strenzke et al. | 60/445 |
| 5,209,063 | A * | 5/1993 | Shirai et al. | 60/422 |
| 5,271,227 | A * | 12/1993 | Akiyama et al. | 60/422 |
| 5,273,069 | A * | 12/1993 | Akiyama et al. | 60/452 |
| 5,279,122 | A * | 1/1994 | Shirai et al. | 60/452 |
| 5,481,872 | A * | 1/1996 | Karakama et al. | 60/452 |
| 5,535,663 | A * | 7/1996 | Yamashita et al. | 60/452 |
| 5,630,317 | A * | 5/1997 | Takamura et al. | 60/452 |
| 6,367,365 | B1 * | 4/2002 | Weickert et al. | 60/422 |
| 6,422,009 | B1 | 7/2002 | Nozawa et al. | |
| 6,644,025 | B1 | 11/2003 | Oberhäusser et al. | |

FOREIGN PATENT DOCUMENTS

| | | |
|---|---|---|
| DE | 199 04 616 A1 | 8/2000 |
| EP | 0 566 449 A1 | 10/1993 |
| EP | 1 099 856 A1 | 5/2001 |

* cited by examiner

*Primary Examiner*—Thomas E. Lazo
(74) *Attorney, Agent, or Firm*—Oliff & Berridge, PLC

(57) ABSTRACT

Disclosed are a control arrangement for actuation of at least two hydraulic consumers, and a method for actuation of these consumers. The latter are supplied with pressure medium through the intermediary of a pump, wherein a respective meter-in orifice and a pressure compensator arranged downstream from the latter are provided between the consumers and the pump. In accordance with the invention, adjustment of the pump is performed in dependence on the target values to which the meter-in orifices are set.

12 Claims, 1 Drawing Sheet

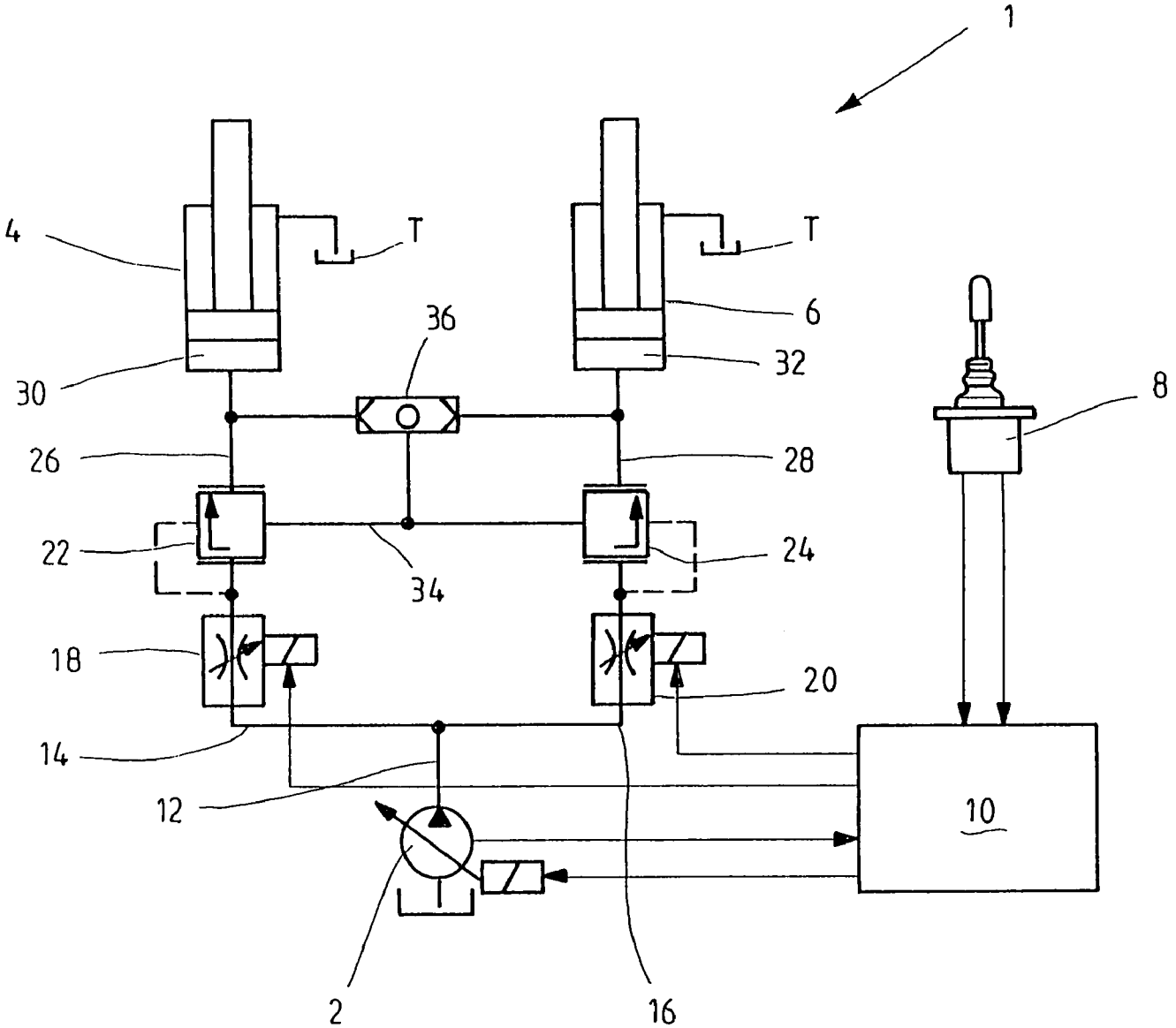
1
8
10
T
6
32
28
24
20
16
36
34
T
2
4
30
26
22
18
14
12

CONTROL ARRANGEMENT AND METHOD FOR CONTROLLING AT LEAST TWO HYDRAULIC CONSUMERS

The invention relates to a control arrangement for the pressure medium supply of at least two hydraulic consumers, and a method for controlling such consumers.

In order to control several consumers, hydraulic systems are frequently employed where the consumers are supplied with pressure medium through the intermediary of a variable displacement pump.

Between the variable displacement pump and each consumer a meter-in orifice and a pressure compensator are provided, wherein the latter may be arranged upstream from the meter-in orifice (flow regulator principle) or downstream from it (flow divider principle).

From EP 0 566 449 A1 a hydraulic control arrangement operating in accordance with the flow divider principle is known, which employs the load-sensing (LS) principle. In such LS systems, a variable displacement pump is adjusted in dependence on the highest load pressure of the actuated hydraulic consumers, such that the supply pressure is higher than the highest load pressure by a specific pressure difference. The pressure medium flows to the two hydraulic consumers via two adjustable meter-in orifices, the first of which is disposed between a pump line issuing from the variable displacement pump and a first hydraulic consumer, and the second of which is disposed between the pump line and the second hydraulic consumer. By means of the pressure compensators arranged downstream from the meter-in orifices (flow divider principle) it is achieved that in the case of a sufficient quantity of supplied pressure medium, a certain pressure difference exists across the meter-in orifices independently of the load pressures of the hydraulic consumers, so that the quantity of pressure medium flowing to a hydraulic consumer depends on nothing but the opening cross-section of the respective meter-in orifice. If the latter is opened further, a greater quantity of pressure medium must flow across it in order to generate the particular pressure difference. The variable displacement pump is then adjusted so as to deliver the required quantity of pressure medium. Accordingly, this is also referred to as flow control according to demand.

The pressure compensators arranged downstream from the meter-in orifices are subjected to the pressure downstream from the respective meter-in orifice in the opening direction, and in the closing direction to a control pressure which prevails in a rearward control chamber and usually corresponds to the highest load pressure of all the hydraulic consumers supplied by a same hydraulic pump. If, upon concurrent actuation of several hydraulic consumers, the meter-in orifices are opened to such an extent that the quantity of pressure medium supplied from the hydraulic pump adjusted to the limit is smaller than the total demanded quantity of pressure medium, the quantities of pressure medium flowing to the single hydraulic consumers are reduced proportionally, independently of the respective load pressure of the hydraulic consumers. Accordingly, this case is referred to as a control with load-independent flow distribution (flow divider principle). Because in such a control the highest load pressure is furthermore tapped, and a supply pressure higher than the highest load pressure by a particular pressure difference is generated by the pressure medium source, a control with load-independent flow distribution practically is a special case of a load-sensing control.

For several hydraulic consumers at which a respective flow of pressure medium arrives via a meter-in orifice with an upstream pressure compensator (flow regulator principle) which is subjected to the pressure upstream from the meter-in orifice in the closing direction, and to the load pressure of the respective hydraulic consumer and a compression spring in the opening direction, it is not possible to obtain a load-independent flow distribution. If several hydraulic consumers are actuated simultaneously while not being supplied with a sufficient quantity of pressure medium delivered from the variable displacement pump, only the quantity of pressure medium flowing to the hydraulic consumer having the highest load pressure is reduced.

In the above described LS systems, the variable displacement pump is actuated in dependence on the highest load pressure, so that a pressure manifests in the pump line which is higher than the highest load pressure by a pressure difference equivalent to the force of a control spring of a pump control valve (so-called $\Delta p$ control of the variable displacement pump).

A solution improved in comparison with the document EP 0 566 449 A1 mentioned at the outset is disclosed in DE 199 04 616 A1, however the above described $\Delta p$ control is also employed in this system. It is a drawback of this control that considerable system losses may be incurred due to the necessity of raising the pressure supplied by the pump above the highest load pressure by the respective above described $\Delta p$, for this pressure difference is situated in a range between 20 to 40 bar. It was moreover found that the $\Delta p$ control exhibits a certain susceptibility to vibration, rendering a continuous actuation of the consumers difficult.

In contrast, the invention is based on the objective of further developing a hydraulic control arrangement for controlling at least two consumers, as well as a method for controlling these consumers, such that the energy losses and the susceptibility to vibration are reduced.

With regard to the control arrangement, this object is achieved through the features of the enclosed claims.

In accordance with the invention, a variable displacement pump (pump having a variable capacity) and adjustable meter-in orifices arranged upstream from each consumer may be actuated proportionally, preferably electrically, wherein the variable displacement pump is actuated in dependence on target values predetermined for the meter-in orifices. In other words, in contrast with the LS systems described at the outset, the variable displacement pump is adjusted not in dependence on a pressure signal corresponding to the highest load pressure, but in dependence on target values predetermined by an operator so as to move the consumer, e.g., at a particular velocity. The adjustment of the variable displacement pump is then performed in dependence on these target values so as to enable it to supply the pre-set target flow rates to all of the consumers. I.e., the variable displacement pump must be adjusted to a swivel angle at which is delivers precisely this requested cumulative consumer flow.

Such a system fundamentally constitutes a flow rate control in which flow rate errors owing to volumetric losses of the pump are not of importance, for when the flow rate and thus the velocity of the consumers is too low, the operator will manually perform a readjustment and thus compensate the flow rate error. As the variable displacement pump is actuated by a flow rate control independently of the highest load pressure, the system has a substantially lower susceptibility to vibration than the known LS control arrangements.

It is a further advantage of the control arrangement of the invention and of the method of the invention that in single operation of a consumer, it is possible to fully open the meter-in orifices outside of the fine control range, wherein the flow rate to the consumer is determined by the actuation of the variable displacement pump: the throttling losses at the meter-in orifice are then minimum. In the operation of several consumers, the throttling losses may be reduced, in accordance with an advantageous development of the invention, in that the meter-in orifice of the one consumer receiving the highest pressure medium volume flow, i.e., the one consumer set to the highest target value, is opened fully, and the cross-sections of the other meter-in orifices are caused to follow up in accordance with the ratio of the pressure medium flow rates, so that the system losses are minimized in comparison with conventional solutions. This case does, however, not occur very frequently as a consumer is as a general rule operated at maximum velocity.

Actuation of the variable displacement pump and of the meter-in orifices is performed through central control means preferably including a data storage, wherein characteristics of the variable displacement pump and of the meter-in orifices are stored.

The variable displacement pump is preferably provided with a rotational speed sensor whereby the current rotational speed of the pump may be detected, so that the target flow rate may be adjusted in a simple manner with the aid of the stored characteristics.

The control arrangement in accordance with the invention is preferably executed with anti-cavitation valves through which pressure medium may be replenished in a low-pressure side of the consumer in the case of a pulling load. In this case, in accordance with the solution of the invention the flow rate of the pump is reduced, so that the system losses are further reduced in comparison with conventional solutions.

An acquisition of the target values is preferably performed by evaluating the adjustment of a joystick or by detecting the position of the control piston of the meter-in orifice.

Further advantageous developments of the invention are subject matter of further subclaims.

In the following a preferred practical example of the invention shall be explained by referring to a circuit diagram.

The FIGURE shows a circuit diagram of a hydraulic control arrangement 1 in accordance with the invention, which practically constitutes a modified control with load-independent flow distribution system.

The control arrangement in accordance with the invention comprises a variable displacement pump 2 whereby the two or more consumers 4, 6 may be supplied with pressure medium. Actuation of the consumers 4, 6 takes place with the aid of a control apparatus, for instance a joystick 8, whereby control signals are output to a control means 10. These signals practically constitute a command to displace the consumer at a particular velocity.

The outlet from the variable displacement pump 2 is connected to a pump line 12 branching into two supply lines 14, 16. In each supply line 14, 16 a respective electrically proportionally adjustable meter-in orifice 18 or 20 is arranged, downstream of which a respective pressure compensator 22 or 24 is arranged. The outlets from the two pressure compensators 22, 24 are connected with the respective consumer via a flow line 26, 28. In the present case, the consumers 4, 6 are hydraulic cylinders, the cylinder chambers of which are connected to the flow line 26 or 28. In practice, the meter-in orifices 18, 20 are embodied as electrically or hydraulically proportionally adjustable directional control valves. In the present hydraulic circuit diagram, the return and drain lines connecting the named cylinder chambers 30, 32 with the tank T, the flow cross-sections of which are preferably also opened and closed by means of the respective proportional valve constituting the meter-in orifice 18, 20, are omitted for the sake of clarity.

The pressure compensators 22, 24 are subjected in the opening direction to the pressure downstream from the respective meter-in orifice 18, 20 and in the closing direction to a pressure corresponding to the highest load pressure at the two consumers 4, 6. This highest load pressure is tapped via a LS line 34 and a shuttle valve 36 from the one flow line 26, 28 at which the highest load pressure prevails.

Actuation of the two meter-in orifices 18, 20 takes place by means of the control means 10 as a function of the control signal set at the joystick 8 (target value).

As was described at the outset, in such a system the pressures downstream from the two meter-in orifices 18, 20 are identical, and the ratio of the magnitudes of the flow rates to the consumers 4, 6 corresponds to the ratio of the opening cross-sections of the two meter-in orifices 18, 20. By means of the downstream pressure compensator 22, 24, the pressure prevailing downstream from the meter-in orifices 18, 20 is throttled to the respective prevailing load pressure.

The variable displacement pump 2 is in the represented practical example executed with a pressure sensor for detecting the pump pressure, a rotational speed sensor for detecting the pump speed, and a swivel angle sensor for detecting the swivel angle of the pump. In the data storage of the control means the characteristics for the variable displacement pump 2 and for the two proportionally adjustable meter-in orifices 18, 20 are moreover stored, so that with the aid of all or some of the above mentioned sensors and of the characteristics, an extremely accurate flow rate control by means of the variable displacement pump 2 is possible. The operation of the control arrangement in accordance with the invention is as follows:

In order to actuate the two consumers 4, 6, control signals are generated by the operator with the aid of one or more joysticks 8 and output to the control means 10. For correspondingly actuating the consumers 4, 6, the variable displacement pump 2 has to provide a particular pressure medium volume flow corresponding to the sum of the target flow rates adjusted by means of the joystick 8. In other words, the variable displacement pump 2 must be adjusted, in dependence on the adjustment of the joystick 8, to a swivel angle at which this cumulative flow rate is delivered. The corresponding adjustment of the variable displacement pump 2 may in a simple manner be achieved in dependence on the target value by detecting the current pump pressure, the current pump speed, and the adjusted swivel angle with the aid of the pump characteristic. I.e., in accordance with the invention the pump controller does not receive a pressure signal that corresponds, as a rule, to the highest load pressure, but actuation of the variable displacement pump is performed solely in dependence on the target values adjusted with the aid of the joystick.

In this target value adjustment with the aid of the joystick 8 it is possible to compensate flow rate errors occurring as a result of volumetric losses of the variable displacement pump 2, for the operator will immediately perform a readjustment with the aid of the joystick 8 if the consumers 4, 6 are not actuated at the desired velocity.

It is another particularity of the invention that in parallel actuation of the consumers 4, 6 through the control means 10, the one consumer 4, 6 is determined that has to be supplied with the highest pressure medium volume flow. This may be achieved in a simple manner with the aid of the target values adjusted at the joystick 8, so that no further sensors are required. The meter-in orifice 18, 20 of this consumer 4, 6 to be supplied with the highest pressure medium volume flow is then opened completely through the control means 10, and the opening cross-sections of the other meter-in orifices 20 or 18 are caused to follow up correspondingly, so that the system losses are minimized in comparison with conventional solutions. In a case in which only one consumer 4, 6 is actuated, the associated meter-in orifice 18 or 20 may be opened fully outside of the fine control range so as to minimize the system losses. The pressure medium volume flow to the consumer is then controlled solely through the variable displacement pump.

In an advantageous practical example of the invention, the cylinder chambers 30, 32 of the consumers 4, 6 are each connected to the tank T by a respective anti-cavitation valve, so that pressure medium may be replenished into the cylinder chambers 30, 32 via these anti-cavitation valves—which are not represented—in the case of a pulling load (low-pressure side). This pressure in the low-pressure side is detected, and by means of the control means 10 a control signal is output to the variable displacement pump 2, so that the swivel angle of the variable displacement pump 2 is reduced, and no pressure medium is conveyed by the pump. By this arrangement, the losses may be minimized further in comparison with conventional arrangements.

In the above described practical example, the target values are predetermined with the aid of a joystick 8. In the case of proportional valves including spool path measurement, the target flow rate may also be determined on the basis of the path of the valve spool of the meter-in orifice 18, 20, i.e., in this case not the signal adjusted at the joystick 8 is used directly, but the actual value manifesting at the valve spools of the meter-in orifices 18, 20 as a result of this signal.

As in the system of the invention a flow rate control is performed through the intermediary of the variable displacement pump 2, the susceptibility to vibration is substantially lower than in the previously known solutions. Thanks to the suppression of the LS indicator lines leading to the control valve, the complexity in terms of control technology may be reduced in comparison with the $\Delta p$ systems described at the outset.

In accordance with the above description, the variable displacement pump may be realized such that the geometric displacement volume is adjustable, however it is also possible to employ constant or variable displacement pumps having a variable speed drive.

Disclosed are a control arrangement for actuation of at least two hydraulic consumers, and a method for actuation of these consumers. The latter are supplied with pressure medium through the intermediary of a pump, wherein a respective meter-in orifice and a pressure compensator arranged downstream from the latter are provided between the consumers and the pump. In accordance with the invention, adjustment of the pump is performed in dependence on the target values to which the meter-in orifices are set.

LIST OF REFERENCE SYMBOLS

1 control arrangement
2 variable displacement pump
4 consumer
6 consumer
8 joystick
10 control means
12 pump line
14 supply line
16 supply line
18 meter-in orifice
20 meter-in orifice
22 pressure compensator
24 pressure compensator
26 flow line
28 flow line
30 cylinder chamber
32 cylinder chamber
34 LS line
36 shuttle valve

The invention claimed is:

1. A control arrangement for the pressure medium supply of at least two hydraulic consumers, comprising a pump having a variable capacity, and comprising two adjustable meter-in orifices, a first one of which is disposed between a supply line issuing from the pump and a first hydraulic consumer, and a second one of which is disposed between a supply line and a second hydraulic consumer, and comprising two pressure compensators, a first one of which is arranged downstream from the first meter-in orifice, and a second one of which is arranged downstream from the second meter-in orifice, and control pistons of which are adapted to be subjected on a front side to a pressure downstream from the respective meter-in orifice in an opening direction, and in a closing direction to a highest load pressure or to a pressure derived therefrom, wherein the pump and the meter-in orifices are adjustable by a control means for outputting a control signal to the pump in which the sum of the target values predetermined for the meter-in orifices is considered.

2. The control arrangement in accordance with claim 1, wherein a flow rate of the pump may be adjusted electrically by means of proportional solenoids.

3. The control arrangement in accordance with claim 1, wherein the meter-in orifice having the highest target value may be opened fully with the aid of the control means, and the other meter-in orifices may be caused to follow up accordingly.

4. The control arrangement in accordance with claim 1, wherein the control means include a data storage wherein characteristics of the pump and of the meter-in orifices are stored.

5. The control arrangement in accordance with claim 1, wherein the pump is an axial piston pump.

6. The control arrangement in accordance with claim 1, further comprising a rotational speed sensor for detecting a speed of the pump.

7. The control arrangement in accordance with claim 1, wherein pressure medium chambers of the consumers are connected with a tank, so that pressure medium may be replenished into the pressure medium chambers in the case of a pulling load.

8. The control arrangement in accordance with claim 1, wherein the target values are detected in dependence on the adjustment of a joystick or in dependence on the control piston position of the meter-in orifices.

9. The control arrangement in accordance with claim 1, wherein the pump and the meter-in orifices are adjustable proportionally.

10. A method for controlling at least two hydraulic consumers adapted to be supplied with pressure medium through the intermediary of a variable-capacity pump, wherein to each consumer a meter-in orifice is associated, that are provided between the pump and the respective consumer and downstream of which a respective pressure compensator is arranged, the control piston of which is subjected to the pressure behind the upstream meter-in orifice in the opening direction, and in a closing direction to a highest load pressure or to a pressure derived therefrom, wherein the pump is operated so that a sum of target values predetermined for the meter-in orifices is considered.

11. The method in accordance with claim 10, wherein the meter-in orifice to be set to the highest target value is opened fully, and the other meter-in orifices are caused to follow up accordingly.

12. The method in accordance with claim 10, wherein the flow rate of the pump is reduced and pressure medium is replenished to the low-pressure side of the consumers in the case of a pulling load.

* * * * *